United States Patent [19]

Riley

[11] Patent Number: 4,677,775

[45] Date of Patent: Jul. 7, 1987

[54] UNIVERSALLY ADJUSTABLE QUILTING FRAME

[76] Inventor: Beatrice W. Riley, 30 Woodland La., Arcadia, Calif. 91006

[21] Appl. No.: 873,965

[22] Filed: Jun. 13, 1986

[51] Int. Cl.[4] ..... D06C 3/08

[52] U.S. Cl. ..... 38/102.2; 38/102.8; 160/380

[58] Field of Search ..... 38/102.1, 102.2, 102.8; 248/188.2, 188.5; 108/132, 133; 160/372, 373, 374, 375, 378, 380, 381

[56] References Cited

U.S. PATENT DOCUMENTS

| | | | |
|---|---|---|---|
| 389,811 | 9/1888 | Herrmenau | 38/102.8 |
| 610,658 | 9/1898 | Maynard | 38/102.2 |
| 1,093,136 | 4/1914 | Jucker et al. | 38/102.2 |
| 1,242,972 | 10/1917 | Pettit | 38/102.2 |
| 1,740,142 | 12/1929 | Atkinson | 38/102.2 |
| 1,951,246 | 3/1934 | Kirpatrick | 38/102.2 |
| 2,746,822 | 5/1956 | Copenhaver | 248/188.5 |
| 2,760,299 | 8/1956 | Gable et al. | 38/102.2 |
| 4,422,251 | 12/1983 | Hedrick | 38/102.2 |

*Primary Examiner*—Werner H. Schroeder
*Assistant Examiner*—Andrew M. Falik
*Attorney, Agent, or Firm*—William W. Haefliger

[57] ABSTRACT

A quilting frame assembly includes a first rectangular frame extending generally horizontally, and legs supporting the first frame to receive a quilt thereover, to drape downwardly adjacent the frame sides, and a second rectangular frame having four elongated members, at least two of such elongated members comprising sections which are relatively movable lengthwise of the members to vary the overall lengths of the members, whereby the second frame is adjustable in size to fit closely about the quilt, at the level of the first frame, to firmly position the quilt on the first frame; springs are usable to urge the sections of each member toward one another.

9 Claims, 7 Drawing Figures

UNIVERSALLY ADJUSTABLE QUILTING FRAME

BACKGROUND OF THE INVENTION

This invention relates generally to quilt frames, and more particularly to an improved frame characterized by ease and quickness of set-up and mounting of a quilt on the frame, as well as sturdy construction.

Prior quilting frames are bulky, difficult to set-up, and require excessive and time consuming adjustment as at frame corners, as for example adjustment of one corner at a time, or adjustment of multiple external holders, one at a time. There is need for an improved frame assembly overcoming these and other problems associated with prior units, and also incorporating unusually advantageous features of construction and modes of operations as are found in the present invention.

SUMMARY OF THE INVENTION

It is a major object of the invention to provide an improved frame assembly, which basically comprises:

(a) a first rectangular frame extending generally horizontally, and legs supporting said first frame to receive a quilt thereover to drape downwardly adjacent the frame sides, (b) and a second rectangular frame having four elongated members, at least two of said elongated members comprising sections which are relatively movable lengthwise of the members to vary the overall lengths of said members, (c) whereby the second frame is adjustable in size to fit closely about the quilt at the level of the first frame, to firmly position the quilt on the first frame.

As will appear, the pairs of members of the second frame are typically rigidly joined together at their ends to form four L-shaped corners of the second frame, and springs are provided for yieldably urging the sections of said members endwise relatively toward one another whereby the quilt may be adjustably clamped by the second frame onto the first frame. Also, guides may be associated with said sections to guide relative endwise movement of the sections toward and away from one another.

Another object is the provision of legs having pivoted attachment to the first frame, and releasable means to maintain the legs alternately in retracted positions adjacent the first frame, and in extended positions wherein the legs extend downwardly from the first frame. In this regard, the first frame may advantageously include four elongated members rigidly joined together to form four rigid corners, there being leg mounts inwardly of said corners and joined to said members, said legs pivotally attached to said leg mounts, said releasable means including plungers carried by said members and having adjustment heads protruding at the outer side of the first frame below the level of the second frame, there being recesses in each leg to receive the end of its associated plunger in either of said leg positions.

These and other objects and advantages of the invention, as well as the details of an illustrative embodiment, will be more fully understood from the following specification and drawings, in which:

DRAWING DESCRIPTION

Figure 1:
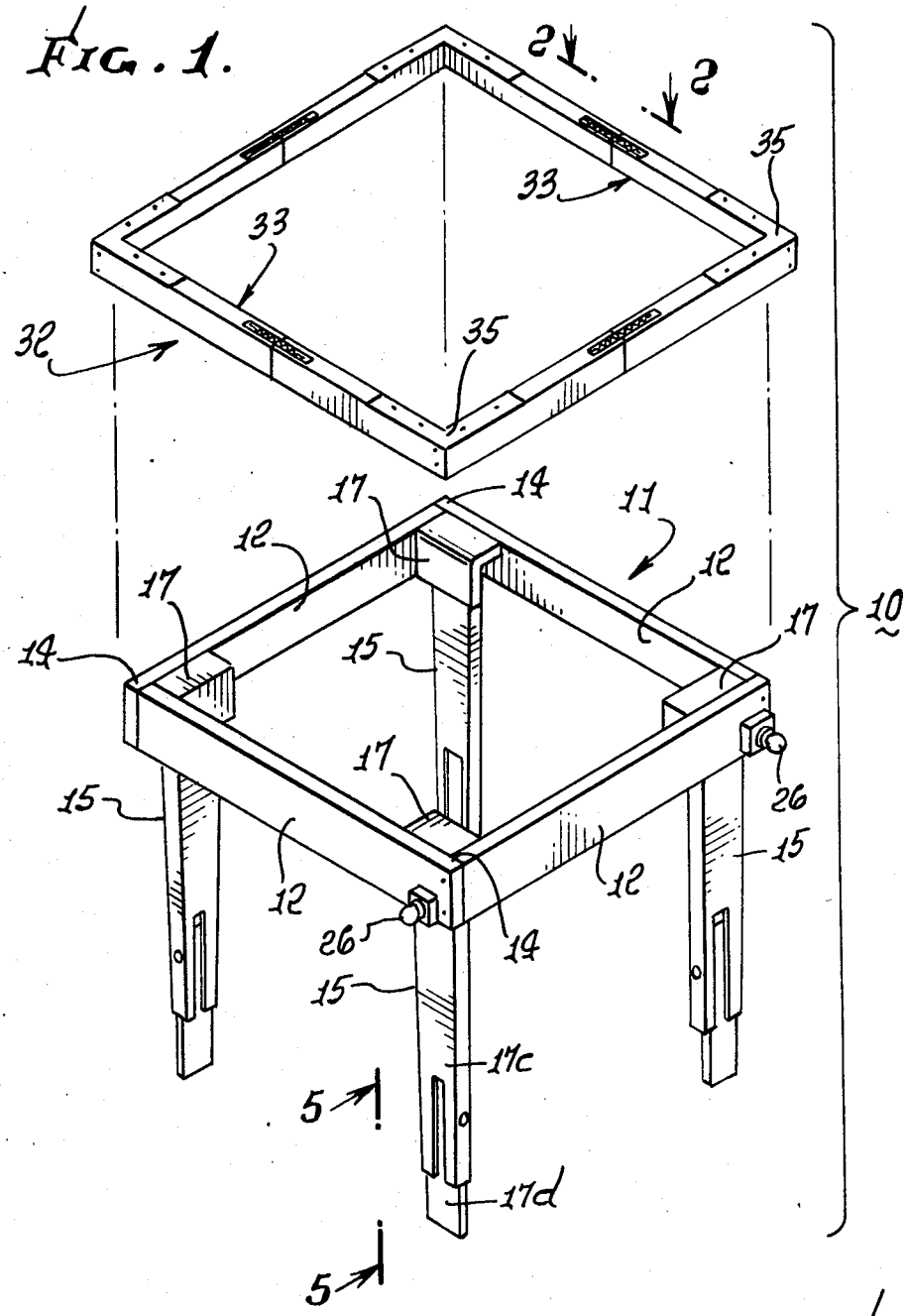
FIG. 1 is an exploded view of a quilting frame assembly embodying the invention.
Figure 2A:
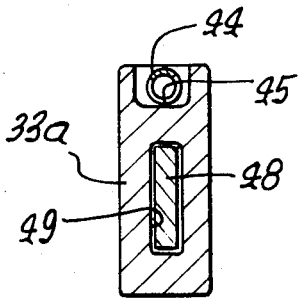
FIG. 2 is an enlarged plan view taken on lines 2—2 of FIG. 1.
Figure 2:
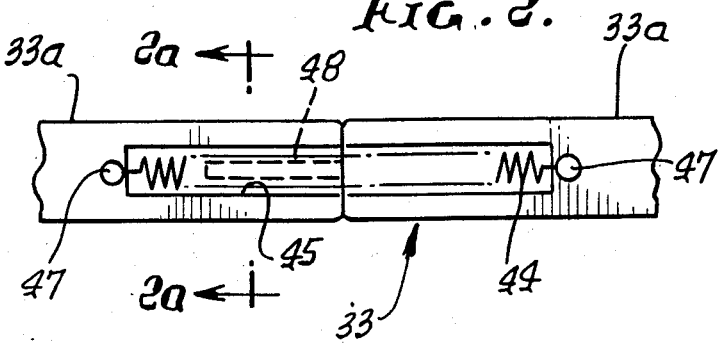
Figure 3:
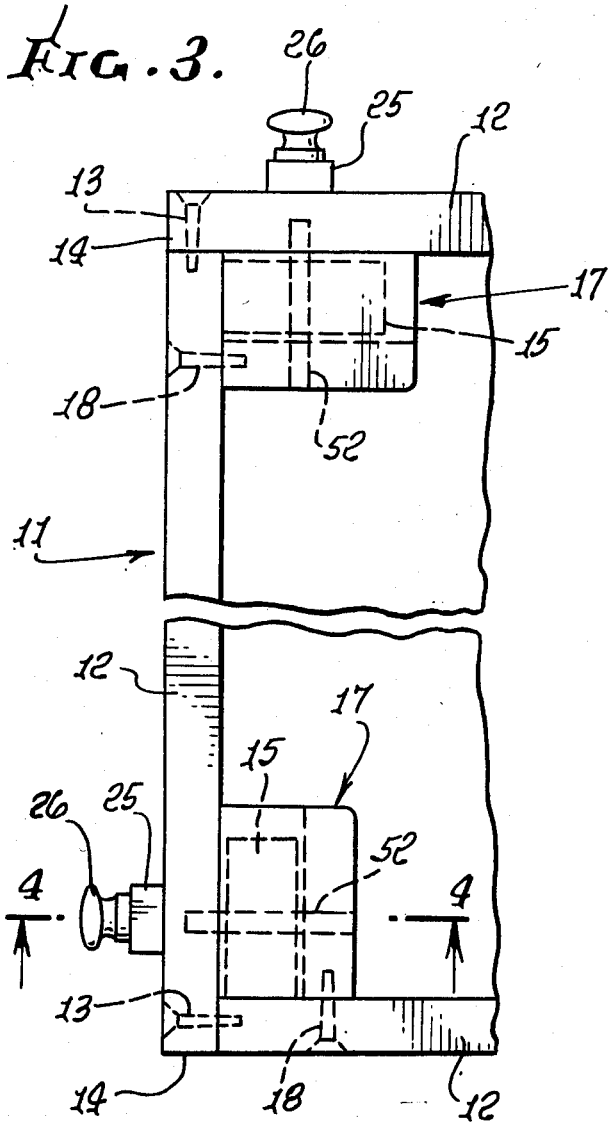
Figure 6:
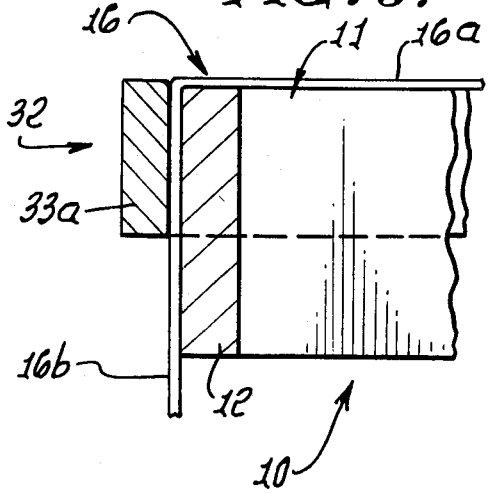
Figure 5:
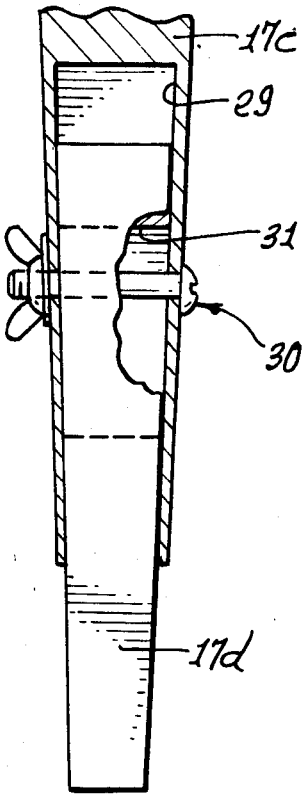
Figure 4:
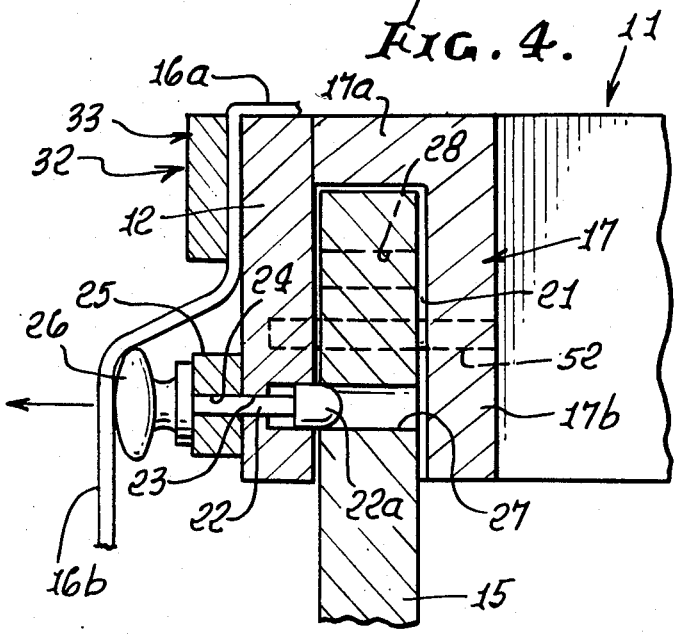

FIG. 2*a* is a section taken on lines 2*a*—2*a* of FIG. 2;

FIG. 3 is an enlarged fragmentary plan view showing rigid corner structure of the frame assembly;

FIG. 4 is a fragmentary section taken on lines 4—4 of FIG. 3;

FIG. 5 is an enlarged fragmentary section taken on lines 5—5 of FIG. 1; and FIG. 6 is a fragmentary section showing interfitting of first and second rectangular frames, with a quilt held therebetween.

DETAILED DESCRIPTION

The quilting frame assembly 10 shown in the drawings includes a first and inner rectangular frame 11 which extends generally horizontally, and includes four elongated members 12 rigidly joined together at their ends as by fasteners 13, to form four corners 14. The members may be of equal length and constructed of wood. Legs 15 support the first frame 11 at an elevation to receive a quilt 16 laid down over the frame and hanging downwardly. See FIG. 6 in this regard, showing the quilt top portion 16*a* extending horizontally, and the quilt skirt portion 16*b* hanging downwardly.

The legs 15 may have pivoted attachment to the first frame, enabling collapse of the legs toward the frame to form a compact, portable assembly. For example, leg mounts 17 are shown as attached to the members 12, as by fasteners 18, rigidly locating the mounts to the frame at the inner sides of corners 14. Mounts 17 are L-shaped, and have top and side portions 17*a* and 17*b*. A leg pivoting and retaining space 21 is formed by each mount 17 and one member 12, as shown in FIG. 4. The upper extent of a leg 15 is pivotally attached to the mount 17, in space 21, as by a pivot rod or dowel 52, whereby the leg may be moved alternatively into retracted position adjacent a member 12 and at the inner side thereof, or into upright extended position, as appears in FIGS. 1 and 4. Releasable means is provided to maintain the legs locked in one or the other of such positions, and may include a plunger 22 slidable in a bore 23 in member 12, and in a bore 24 in part 25, toward and away from the leg 17. A manipulable adjustment head 26 is carried at the outer side of the plunger, and the quilt skirt 16*b* may drape over that head as shown in FIG. 4. The plunger inner end 22*a* is received into a recess 27 in the upright position of the leg in leg upright position, or into a recess 28 in th leg in leg upwardly collapsed position. Thus, the legs can be locked in either such position.

Further the lengths of the legs can be adjusted to raise or lower the supported quilt on the frame, to the user's advantage. See leg upper and lower sections 17*c* and 17*d* in FIGS. 1 and 5, section 17*d* adjustably and telescopically movable up and down in a slot 29 in 17*c*. A fastener 30 carried by section 17*c* extends horizontally through a vertically elongated slot 31 in section 17*d*, and may be tightened to hold the sections at selected leg height position.

The assembly 10 also includes a second rectangular frame 32 that adjustably fits downwardly about the quilt skirt at the level of the first frame, to firmly position and retain the quilt on the first frame, whereby quilt top portion 16*a* is held or stretched firmly on the assembly. Frame 32 also has four elongated members 33 corresponding to members 12; however each member 33 comprising two sections 33*a* which are alike, which extend in endwise alignment, and which are relatively movable endwise; to vary the overall lengths of each of the members 33*a;* however, the ends of the member sections 33*a* closest to corners 14 are rigidly joined together at 35, to define 90° corners which fit over the quilt adjacent corners 14. The fixed angularity corners 14 and 35 cooperate to closely confine the quilt therebetween, holding it in stretched position at 16*a*.

The construction described enables different thickness quilts to be so accomodated, and also facilitates ease of positioning of the frame 32 over the quilt and frame 11. This is further enabled by providing tension springs 44 yieldably urging the sections 33*a* toward one another, endwise, and allowing their adjustable endwise separation. As shown, the endwise aligned sections 33*a* of each pair define elongated recesses 45 receiving a spring 44, the opposite ends of which are attached to the sections as at 47. Also, guides 48 associated with the sections act to guide relative endwise movement of the sections, toward and away from one another. To this end, an elongated guide bar 48 may be attached to one section 33*a* to protrude endwise, and slidably fit in a recess 49 in the other section. See FIG. 2*a*.

Both frames and the legs may consist of wood, or other material.

I claim:

1. In a quilting frame assembly, the combination comprising:

(a) a first rectangular frame extending generally horizontally, and legs supporting said first frame to receive a quilt thereover to drape downwardly adjacent the frame sides, (b) and a second rectangular frame having four elongated members, at least two of said elongated members comprising sections which are relatively movable lengthwise of the members to vary the overall lengths of said members, (c) whereby the second frame is adjustable in size to fit closely about the quilt at the level of the first frame, to firmly position the quilt on the first frame, (d) pairs of said members being rigidly joined together at their ends to form four L-shaped corners of the second frame.

2. The combination of claim 1 wherein each of said elongated members of the second frame comprises sections which are relatively movable as defined in claim 1.

3. The combination of claim 1 including springs yieldably urging sections of said members endwise relatively toward one another whereby the quilt may be adjustably clamped by the second frame onto the first frame.

4. The combination of claim 3 including guides associated with said sections to guide relative endwise movement of the sections toward and away from one another.

5. The combination of claim 3 including said quilt which is adjustably and resiliently clamped on the first frame by members of the second frame.

6. The combination of claim 1 wherein said legs have pivoted attachment to the first frame, and releasable means to maintain the legs alternately in retracted positions adjacent the first frame, and in extended positions wherein the legs extend downwardly from the first frame.

7. The combination of claim 6 wherein each of said legs includes two sections one of which is adjustably movable relative to the other section to adjust the length of said legs, whereby the heights of the frames above a leg support surface may be adjusted.

8. In a quilting frame assembly, the combination comprising:

(a) a first rectangular frame extending generally horizontally, and legs supporting said first frame to receive a quilt thereover to drape downwardly adjacent the frame sides, (b) and second rectangular frame having four elongated members, at least two of said elongated members comprising sections which are relatively movable lengthwise of the members to vary the overall lengths of said members, (c) whereby the second frame is adjustable in size to fit closely about the quilt at the level of the first frame, to firmly position the quilt on the first frame, (d) and including springs yieldably urging sections of said members endwise relatively toward one another whereby the quilt may be adjustably clamped by the second frame onto the first frame, (e) the sections defining lengthwise extending recesses receiving said springs.

9. In a quilting frame assembly, the combination comprising:

(a) a first rectangular frame extending generally horizontally, and legs supporting said first frame to receive a quilt thereover to drape downwardly adjacent the frames sides, (b) and a second rectangular frame having four elongated members, at least two of said elongated members comprising sections which are relatively movable lengthwise of the members to vary the overall lengths of said members, (c) whereby the second frame ia adjustable in size to fit closely about the quilt at the level of the first frame, to firmly position the quilt on the first frame, (d) said legs having pivoted attachment to the first frame, and releasable means to maintain the legs alternately in retracted positions adjacent the first frame, and in extended positions wherein the legs extend downwardly from the first frame, (e) said first frame including four elongated members rigidly joined together to form four rigid corners, there being leg mounts inwardly of said corners and joined to said members, said legs pivotally attached to said leg mounts, said releasable means including plungers carried by said members and having adjustment heads protruding at the outer side of the first frame below the level of the second frame, there being recesses in each leg to receive the end of its associated plunger in either of said leg positions.

* * * * *